United States Patent [19]

Welch et al.

[11] 4,441,558

[45] Apr. 10, 1984

[54] VALVE

[75] Inventors: William R. Welch, Carrollton, Tex.; Thomas J. Heard, Dubai, United Arab Emirates

[73] Assignee: Otis Engineering Corporation, Dallas, Tex.

[21] Appl. No.: 368,690

[22] Filed: Apr. 15, 1982

[51] Int. Cl.[3] ..... E21B 34/08; E21B 34/10

[52] U.S. Cl. ..... 166/317; 166/322; 166/321; 166/332; 137/71

[58] Field of Search ..... 166/317, 319, 320, 321, 166/322, 316, 332, 373, 374; 137/71, 69, 70

[56] References Cited

U.S. PATENT DOCUMENTS

| | | | |
|---|---|---|---|
| 3,874,634 | 4/1975 | Gazda | 166/322 |
| 3,990,511 | 11/1976 | Gazda | 166/322 |
| 4,044,829 | 8/1977 | Jessup et al. | 166/374 |
| 4,201,364 | 5/1980 | Taylor | 166/332 |

*Primary Examiner*—James A. Leppink

*Assistant Examiner*—Hoang C. Dang

*Attorney, Agent, or Firm*—Roland O. Cox

[57] ABSTRACT

A well system in which a dual annular type valve with wall flow ports, operable by ambient pressures, is utilized as part of the well tool string to provide an unrestricted flow path for production through and prevent excess back pressure on the producing formation. The valve has outside seals and internal valves above and below the wall ports controlling flow therethrough. Higher pressure outside the valve will open the biased closed lower sleeve valve to production flow through the wall ports into the flow path through the well production tubing. If pressure in the flow path through increases, both valves close preventing flow out through the wall ports. Increasing flow path pressure to a predetermined value shears lower valve seat positioning pins to open wall flow ports to high volume flow pumped into the formation to kill the well and to two-way flow afterward.

14 Claims, 5 Drawing Figures

VALVE

BACKGROUND

This invention pertains to valves and particularly to a dual valve of the annular type which may be included in a string of well tools or well tubing and operated by ambient pressures to control flow through flow ports in the valve housing wall.

In a well completed for production using pumpdown or through flow line techniques and tools, the tool string pumped down the production tubing to open the tubing to flow from a producing formation usually includes a ball type check valve. The primary function of the ball type check valve, which is old and well known, is to protect the producing formation from back pressures which may occur while circulating fluids through the pumpdown system or when system pressure is increased to cause positive actuation of servicing tools during service operations. Flow back into producing formations, caused by pressures at the formation producing interval face higher than formation pressure, can be very detrimental to the producing ability of a formation. If the formation is permanently damaged by flow into and cannot be repaired by expensive workover procedures, cumulative production from the formation may be definitely limited and the life of the well shortened, resulting in great economic loss.

Ordinary ball-type check valves previously utilized in well tool strings in production tubing inherently limit well production flow and only function in a formation protecting capacity to prevent reverse flow to kill wells or pump into formations.

One type of annular valve operated by pressure is disclosed in U.S. Pat. No. 3,403,694 to Brown.

SUMMARY

The dual annular valve of the present invention, when replacing a ball-type check valve in a well tool string, not only prevents excessive back pressure and flow into a producing formation, but also provides a full bore longitudinal flow path through for produced or pumped into formation flow. Wall flow ports, which may be permanently opened to flow if required, are provided between outside housing seals and intersecting the flow path through. There are biased closed annular valves inside the housing above and below the wall ports controlling flow therethrough. The upper valve surrounds the lower valve sleeve in the housing and seats in the housing above the wall ports.

The lower valve sleeve sealingly engages a lower seat sleeve which is held in valve sleeve engaging position in the housing by shear pins. The pins are sheared and seat sleeve moved out of valve engaging position by a predetermined higher internal valve pressure opening the wall ports to flow.

An object of this invention is to provide a dual valve useful in well completions having an unrestricted flow path to fluids flowing therethrough.

Another object of this invention is to provide a dual valve useful in well completions which will permit flow through wall ports into the unrestricted flow path from outside.

Another object is to provide a dual valve which prevents outflow through wall ports from the unrestricted flow path until a predetermined flow path pressure is reached.

Another object of the valve of this invention is to provide a valve for well completions which will permit in or outflow through wall ports on exceeding a predetermined pressure in the unrestricted flow path through the valve.

Also, an object of this invention is to provide a dual annular valve wherein the valves may self-align for sealing engagement with their seats.

BRIEF DESCRIPTION OF THE DRAWINGS

Referring now to FIG. 1, there is shown a well 10 in which the valve of the present invention may be utilized, cased with a casing 11 and equipped with a production tubing 12 and a circulating tubing 13 passing through a packer 14 which is anchored and sealed to the well casing 11. A sliding sleeve valve 15 is provided in the production tubing 12 below the packer 14. A sliding sleeve valve operated by a sliding sleeve valve shifting device is shown in U.S. Pat. Nos. 3,874,634 and 3,990,511, both to Gazda, herein incorporated by reference. An "H" member 16 is connected to each tubing below the sliding valve 15, providing an internal flow path between tubings for fluids pumped down the circulating tubing 13 through the connecting flow path in the "H" member into and up the production tubing 12 or pumped down the production tubing 12 and through the "H" member 16 and up the circulating tubing 13. Landing nipples 17 are provided at the lower end of both tubings, and each landing nipple is plugged with a plug 18.

DESCRIPTION OF THE PREFERRED EMBODIMENT

Figure 3:
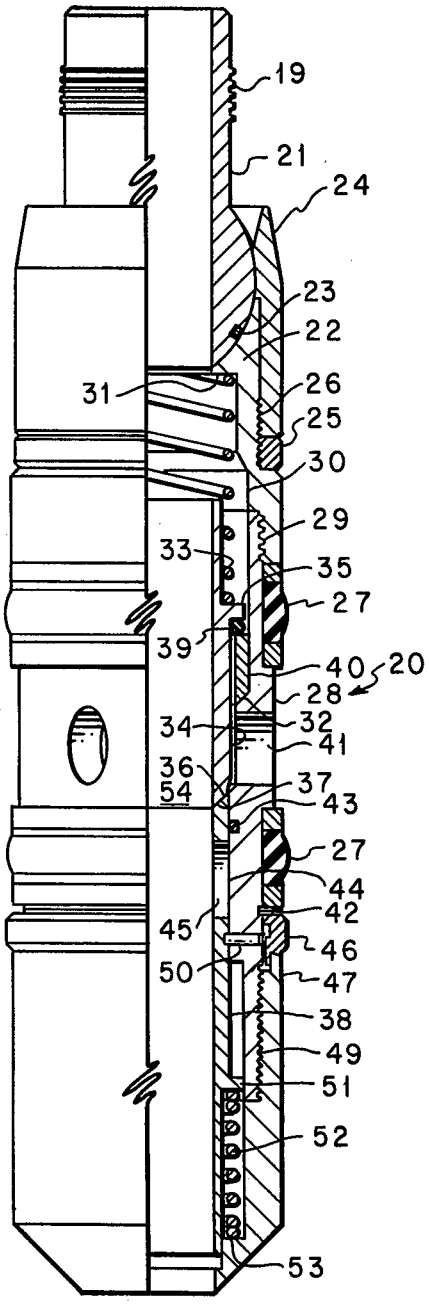
FIG. 3 is an elevational view, half-sectioned, of the preferred form of the dual valve of the present invention, showing the wall ports closed to outflow.

Referring now to FIG. 3, there is shown dual valve 20 of the present invention wherein a threaded connection 19 is provided on the upper end of ball swivel member 21. The ball swivel member 21 is swivelably retained on the seat swivel member 22 by swivel cap 24 and sealed thereto by resilient seal 23. A jam nut 25 is provided on thread 26 connecting swivel cap 24 to seat swivel member 22 to retain swivel cap 24 in position for proper swiveling of ball swivel member 21 as required in pumpdown wells. Upper resilient seal 27 is retained by connecting seat member 22 to housing with threads 29 and seals on housing 28.

Inside seat member 22 is a bore 30 extending down into housing 28. There is a shoulder 31 at the upper end of bore 30 in seat member 22. Bore 30 terminates at a seat 32 at its lower end in housing 28. One end of a spring 33 in bore 30 around lower valve sleeve 34 presses against shoulder 31. The other end of spring 33 presses valve sleeve 34 down through shoulder 35 to engage valve seal surface 36 on valve sleeve 34 with seat seal surface 37 on seat sleeve 38. At the same time, resilient seal 39 sealing lower valve sleeve 34 to upper valve 40 is compressed by shoulder 35 to engage upper valve 40 with seat 32. Wall flow ports 41 are provided in housing 28, and lower resilient seal 27 is positioned below flow ports 41 on housing 28 by retaining ring 42. A resilient seal 43 is positioned in a groove in lower housing bore 44 slidably sealing seat sleeve 38 to housing 28. At least one port 45 is provided in seat sleeve 38. A guide ring 46 is retained against retaining ring 42 by lower housing 47 when connected to housing 28 by thread 49. A shearable pin 50 positions seat sleeve 38 in housing 28 and lower housing bore 44 and in position for seat seal surface 37 to be engaged by valve seal surface 36 on lower valve sleeve 34. A spring 52, stronger than spring 33, is compressed between lower shoulder 51 and lower housing shoulder 53, biases seat sleeve 38 upwardly, loading pin 50 in shear. An unrestricted full bore longitudinal flow passage 54 is provided through the dual valve 20.

Figure 1:
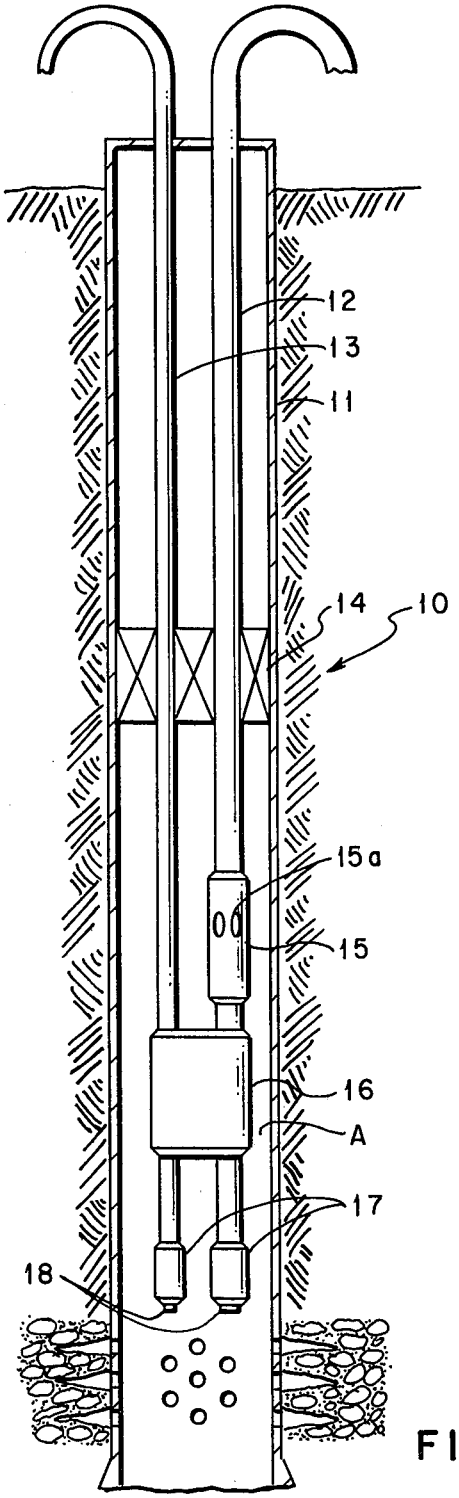
FIG. 1 is a schematic drawing of a well completed for pumpdown tool operation.
Figure 2:
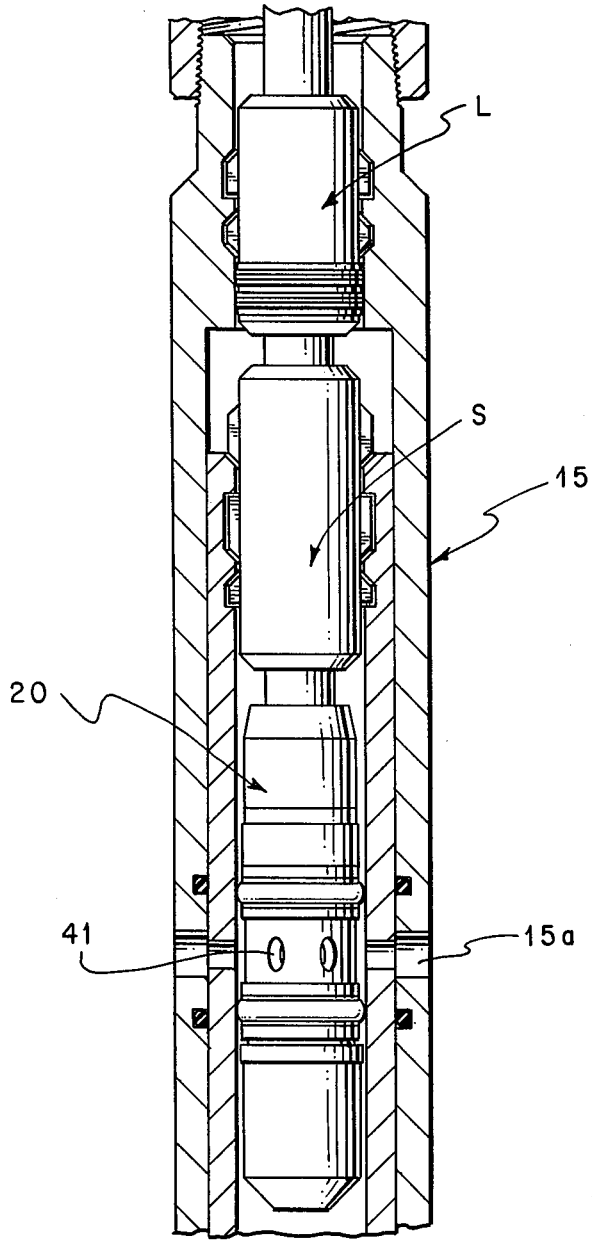
FIG. 2 is a schematic drawing of a well tool string, including the valve of the present invention, useful in operating the well depicted in FIG. 1.

To utilize the dual valve of the present invention in a pumpdown well completion 10 shown schematically by FIG. 1, and establish well flow, the dual valve 20 may be attached to a pumpdown tool string as shown in FIG. 2 with threads 19 and pumped down the production tubing 12 and into sliding sleeve valve 15. Shifter S in the tool string opens sleeve valve ports 15*a* to inflow from well annulus A and ports 41 in dual valve 20 are aligned with ports 15*a*. Locking mandrel L is operated to position and lock valve 20 inside sleeve valve 15 with upper seal 27 (FIG. 3) sealed above wall ports 15*a* and lower seal 27 sealed below wall ports 15*a*, with wall ports 41 in valve housing 28 in pressure communication with ports 15*a* of sliding sleeve valve 15. The dual valve 20 may also be attached to a wireline tool string and positioned to be utilized downhole in a well by wireline methods. In dual valve 20, compressed spring 33 biases valve seal surface 36 to engage seat deal surface 37. Spring 33 also compresses resilient seal 39 through shoulder 35 to engage sleeve valve 40 with seat 32, closing flow ports 41 to inflow.

When pressures in production tubing 12 and flow passage 54 become higher than formation and annulus A pressure, compressed spring 33, compressed resilient seal 39 and down force of tubing 12 pressure acting on the sealed annular area between outer valve 40 and inner valve sleeve 34 sealingly engages valve 40 on body seat 32 and valve seal surface 36 on seat seal surface 37 (FIG. 3), preventing flow from flow passage 54 out through ports 41 and 15*a* into annulus A and the producing formation. Clearance between the inside of valve 40 and the outside of valve sleeve 34 and the resiliency of seal 39 permits valve 40 and valve sleeve 34 to align with and sealingly engage their respective seats 32 and 37 at the same time.

Figure 4:
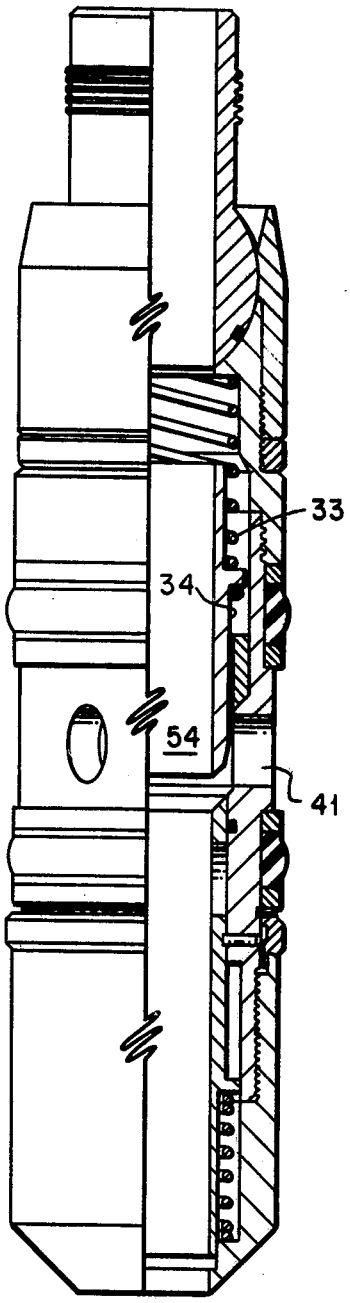
FIG. 4 is a half-sectioned view in elevation of the invention valve, showing the wall ports open for inflow.

Higher pressure formation fluids entering ports 15*a* and ports 41 from annulus A, acting on the sealed annular area between outer valve 40 and inner resilient seal 43, produce an upward force sufficient to overcome down force of spring 33 to lift valve sleeve 34 (see FIG. 4) and compress spring 33, for production flow into flow passage 54, up and into production tubing 12.

Figure 5:
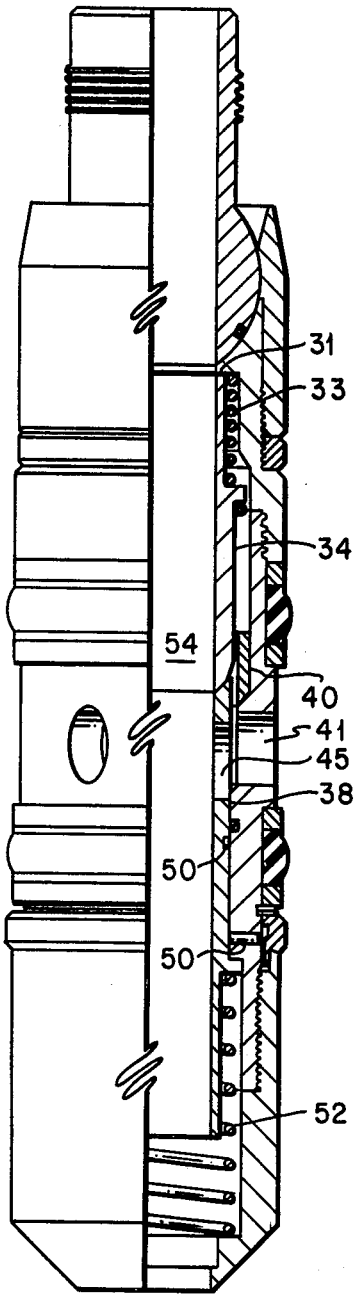
FIG. 5 is an elevational view of the invention valve, half-sectioned, showing the wall flow ports open to two-way flow.

In an emergency situation, requiring large volumes of liquid to be pumped into the well as a formation pressure overburden to "kill" the well, pressure in production tubing 12 and flow passage 54 may be increased sufficiently to produce down force, acting on the sealed annular area between outer valve 40 and inside seat sleeve 38, on seat sleeve 38 to shear pins 50 releasing stronger spring 52. After reducing pressure in flow passage 54, spring 52 moves seat sleeve 38 and valve sleeve 34 up to contact shoulder 31 while compressing spring 33 and aligning port 45 with flow ports 41 (FIG. 5) to provide a large flow passage for fluids pumped through sleeve valve ports 15*a* into well annulus A onto the producing formation, rapidly killing the well. Two-way flow may now occur between flow passage 54 and annulus A through ports 15*a*, 41 and 45.

The valve 20 may be modified by replacing lower housing 47 with a cap closing flow passage 54 to flow from below and utilized in combination with an appropriate locking mandrel in a ported landing nipple in well tubing to control flow between flow passage 54 and a well annulus.

The valve 20 may also be utilized in well tubing to control flow from a well annulus into the tubing by providing appropriate well tubing connections on the upper end of swivel member 22 and on the lower end of lower housing 47. Resilient seals 27 and swivel members 21, 23 and 24 would not be required for utilizing the valve of this invention in well tubing.

What is claimed is:

1. A valve for use in a well, comprising:

a. a tubular housing with a bore therethrough;

b. flow passage means in said housing communicating said housing bore with the exterior of said housing;

c. upper valve means downwardly biased to sealingly engage said housing above said flow passage means and sealingly engage movable seat means in said housing, below said passage means, providing a lower valve cooperating with said upper valve means permitting flow through said passage means into said housing bore and preventing flow from said bore through said passage means; and d. said movable seat means being releasably positioned and upwardly biased in said housing and movable by said bias after release by predetermined pressure in said housing bore to open said flow passage means to flow.

2. The valve of claim 1 wherein said valve means include:

a. a first valve sleeve slidably mounted in said housing, extending below said passage means, having a seal surface on its lower end and an intermediate shoulder thereon above said passage means;

b. a second valve sleeve slidably mounted around said first valve sleeve below said shoulder, having a seal surface on its lower end engageable with an annular seat in said housing above said passage means;

c. means sealing said first valve sleeve to said second valve sleeve; and d. downward biasing means for sealingly engaging said first and second sleeves and said annular housing seat.

3. The valve of claim 2 wherein said sealing means include a resilient seal around the first valve sleeve between the sleeve shoulder and the second valve sleeve and wherein said biasing means include a spring around the first valve sleeve between the sleeve shoulder and a shoulder in the housing.

4. The valve of claim 3 including resilient seal means on said housing above and below said flow passage means and a well tool string connection on one end of said housing.

5. The valve of claim 4 wherein said resilient seal means are molded resilient seals.

6. The valve of claim 1 wherein said movable seat means include:

a. a seat sleeve with a sealing surface on one end, a shoulder thereon toward the opposite end and at least one flow port through said sleeve wall;

b. frangible means positioning said seat sleeve in said housing;

c. a resilient seal sealing said seat sleeve in said housing; and d. biasing means acting on said seat sleeve shoulder loading said frangible means in shear.

7. The valve of claim 6 wherein said frangible means is a shear pin.

8. The valve of claim 6 wherein said biasing means is a spring.

9. The valve of claim 6 or 3 whereiin said resilient seals are o-rings.

10. The valve of claim 1, 2, 3, or 4 in combination with a locking mandrel in a well tool string.

11. The valve of claim 1, 2, 6, 3, or 4 in combination with a locking mandrel in a well tool string and a ported landing nipple in a well tubing string.

12. The valve of claim 1, 2, 3, or 4 connected below a sliding sleeve valve shifting device in a well tool string including a locking mandrel connected above said shifting device.

13. The valve of claim 1, 2, 6, 3 or 4 connected below a sliding sleeve valve shifting device in a well tool string including a locking mandrel connected above said shifting device, and said well tool string installed in a sliding sleeve valve in well tubing.

14. The valve of claim 1 wherein said flow passage means comprise at least one port through said housing wall.

* * * * *